United States Patent [19]

Webb et al.

[11] 4,226,289

[45] Oct. 7, 1980

[54] INDEPENDENT ONE-WAY ACTING HYDRAULIC JAR SECTIONS FOR A ROTARY DRILL STRING

[76] Inventors: Derrel D. Webb, 802 Axilda, Houston, Tex. 77017; Edwin A. Anderson, 1104 Chimney Rock Rd., Houston, Tex. 77056

[21] Appl. No.: 34,181

[22] Filed: Apr. 27, 1979

Related U.S. Application Data

[63] Continuation of Ser. No. 856,650, Dec. 2, 1977, abandoned.

[51] Int. Cl.[2] ..... E21B 1/10

[52] U.S. Cl. ..... 175/297

[58] Field of Search ..... 175/296, 297

[56] References Cited

U.S. PATENT DOCUMENTS

| | | | |
|---|---|---|---|
| Re. 23,354 | 4/1951 | Storm | 175/297 |
| 2,659,576 | 11/1953 | Linney | 175/297 |
| 3,388,755 | 6/1968 | Webb | 175/297 |
| 3,566,981 | 3/1971 | Love | 175/297 |
| 3,583,187 | 12/1974 | Sutliff | 175/297 |
| 3,804,185 | 4/1974 | Mason | 175/297 |
| 3,949,821 | 4/1976 | Rangust | 175/297 |

*Primary Examiner*—William F. Pate, III

*Attorney, Agent, or Firm*—Jack W. Hayden

[57] ABSTRACT

First and second separate one-way acting hydraulic jar sections each include inner and outer telescopically arranged tubular members with means for connecting one end of each the inner and outer tubular members of each jar section in the drill string. Spaced seal means between the inner and outer tubular members form a chamber in each jar section for confining hydraulic operating fluid.

Hydraulic jar means are formed by cooperating means on the inner and outer tubular members within each operating fluid chamber. The cooperating means is spaced axially and disengaged in each fluid chamber when the drill string is in tension and compression during rotary drilling operation to inhibit damage and wear thereto. The hydraulic jar means in the first jar section is constructed to deliver an up jar and the jar means in the separate second jar section is constructed to deliver a down jar to the drill string.

Drive means in a sealed chamber in each jar section connect the inner and outer tubular members of each jar section to allow relative longitudinal movement while preventing relative rotation therebetween. Means to equalize pressure adjacent one end of each of the chambers with the pressure in the well bore is provided in each jar section, which accommodates relative longitudinal movement of the inner and outer tubular members of each jar section for selectively creating an up or down jarring force independently of the well bore pressure.

18 Claims, 10 Drawing Figures

DOWN JAR

UP JAR

INDEPENDENT ONE-WAY ACTING HYDRAULIC JAR SECTIONS FOR A ROTARY DRILL STRING

This is a continuation of application Ser. No. 856,650 filed Dec. 2, 1977, now abandoned.

CROSS REFERENCE TO RELATED APPLICATION

The present invention represents an alternate form of the invention disclosed in application for patent filed in the United States Patent Office on Mar. 28, 1977, bearing Ser. No. 782,011 for Double Acting Jar, now U.S. Pat. No. 4,109,736.

DESCRIPTION OF THE PRIOR ART

The prior art with which applicants are familiar is as follows: U.S. Pat. Nos. Re 23,354; 3,566,981; 3,955,634 and 3,987,858.

SUMMARY OF THE INVENTION

Various type hydraulic jars have been provided and are in use that are adapted to be incorporated in a drill string during drilling operations to apply a jarring impact to the drill string if it becomes stuck in the well bore. In addition, various prior art devices disclose hydraulic jars for delivering an up blow or jar to the drill string in which the operating fluid chamber and the lubricant fluid chamber for the drive means are equalized with the pressure in the well bore.

The prior art also discloses the use of a hydraulic up and a hydraulic down actuated jar arrangement.

However, in the hydraulic up and down jar arrangements of the prior art with which applicants are familiar, certain undesirable problems are encountered. For example, so far as applicants are aware, the prior art hydraulic up and down jar arrangements are such that when the jar has been actuated in either an up or down direction, and if it is then desired to apply another jarring blow in the same direction in which the previous jarring blow has been applied, an indeterminate and substantial amount of time is lost in slowly forcing, or trying to reposition the hydraulic jar arrangement so that it can then be again actuated in the same direction as the previous jar blow.

In hydraulic jar arrangements with which applicants are familiar, there is no means to maintain the hydraulic jar mechanism in axially spaced, or non engaged, relationship when the drill string is in tension or compression during rotary drilling operations, and which hydraulic jar mechanism is also equalized with the pressure in the well bore so that the jarring force may be applied independently of the well bore pressure. Thus, the hydraulic jarring arrangements of the prior art which remain in engaged relation when the drill string is either in tension or compression during drilling operations, may be subject to substantial wear and possible damage.

Applicants are not familiar with any prior art hydraulic jars that employ separate up and down hydraulic jar sections for connection in a drill string with each jar section having its operating mechanism independent of the other with the hydraulic jar operating mechanism of each section being disengaged while the drill string is either in tension or compression during rotary drilling operations, and equalized with the pressure in the well bore so that the force or jarring blow may be applied either up or down independently of the pressure in the well bore.

Also, applicants are not aware of any combination hydraulic up and down jar arrangement, each of which has its own operating mechanism, and which may be employed to selectively deliver an up and down jar, or repeatedly apply an up jar or repeatedly apply a down jar with a minimum of lost time.

Also, applicants are not aware of any combination hydraulic up and down jar arrangement, each of which has its own operating mechanism, and which may be employed to selectively deliver an up and down jar, or repeatedly apply an up jar or repeatedly apply a down jar with a minimum of lost time and which is constructed and arranged to automatically reset itself in the well bore to accomplish the desired jarring action.

An object of the present invention is to provide a hydraulic jar or a hydraulic down jar or a combination of a separate up and down jar which overcomes the above and other disadvantages in the prior art.

Yet a further object of the present invention is to provide a one-way acting hydraulic jar in which the jarring arrangement is spaced axially and non engaged when the drill string is in tension or compression during rotary drilling operations.

Yet a further object of the present invention is to provide a one-way acting hydraulic jar in which the jarring arrangement is spaced axially and non engaged when the drill string is in tension or compression during rotary drilling operations and wherein the jarring arrangement is equalized with the pressure in the well bore so that a jar may be delivered by the hydraulic one-way acting jar arrangement independent of the pressure in the well bore.

Yet a further object of the present invention is to provide first and second separate one-way acting hydraulic jar sections for use in a drill string wherein the hydraulic jar mechanism of each separate section is spaced axially and disengaged while the drill string is in tension or compression during rotary drilling operatons.

Yet a further object of the present invention is to provide first and second separate one-way acting hydraulic jar sections for use in a drill string wherein the hydraulic jar mechanism of each separate section is spaced axially and disengaged while the drill string is in tension or compression during rotary drilling operations and wherein each jar section is constructed and arranged so that it is automatically reset with a minimum of time and effort to selectively deliver a plurality of up jars, or a plurality of down jars, or a combination of up and down jars to the drill string.

Yet a further object of the present invention is to provide first and second separate one-way acting hydraulic jar sections for use in a well string wherein the hydraulic jar mechanism of each separate section is spaced axially and disengaged while the drill string is in tension or compression during rotary drilling operations and wherein each jar section is constructed and arranged so that it is automatically reset with a minimum of time and effort to selectively deliver a plurality of up jars, or a plurality of down jars, or a combination of up and down jars to the drill string and wherein each hydraulic jar section is equalized with the pressure in the well bore so that either an up or down jar may be hydraulically effected independently of the pressure in the well bore.

Yet a further object of the present invention is to provide first and second separate up and down acting hydraulic jar sections which may be employed together in a well string or which may be spaced longitudinally in the well string as desired, or which may be individually employed in a well string, with each section including a jarring mechanism that is disengaged while the drill string is in tension or compression during rotary drilling operations and which is equalized with the pressure in the well bore so that a jar may be applied to the drill string independently of the pressure in the well bore.

Other objects and advantages of the present invention will become more readily apparent from a consideration of the following drawings and description.

DESCRIPTION OF THE PREFERRED EMBODIMENT

Figure 1:
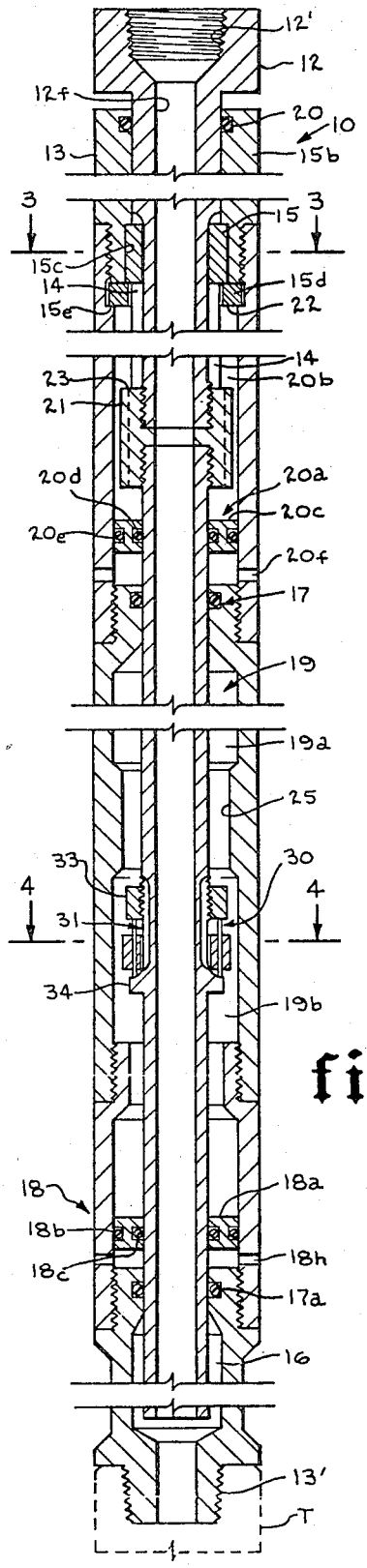
FIG. 1 is a vertical sectional view illustrating the hydraulic jar section of the present invention for delivering an up jar or blow.
Figure 2:
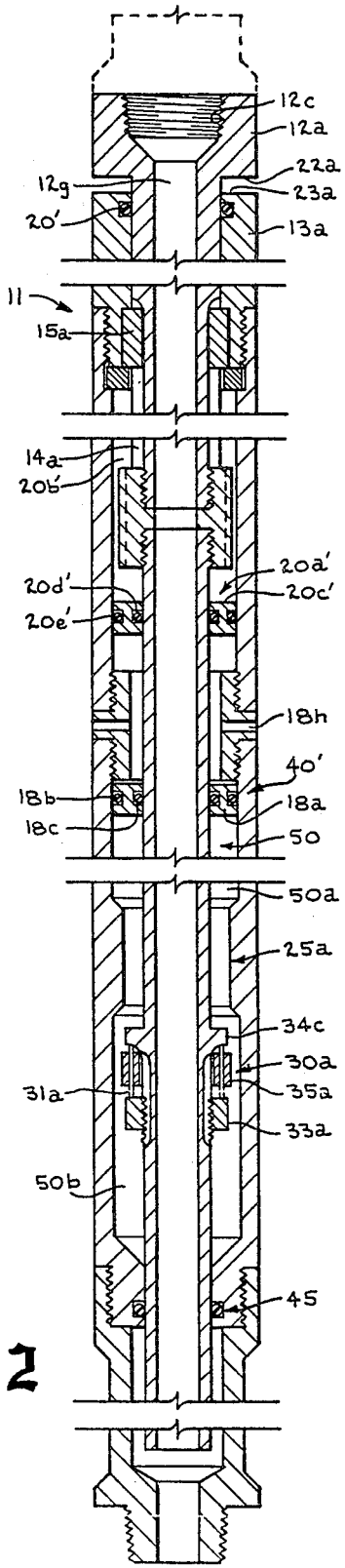
FIG. 2 is a vertical sectional view illustrating the separate hydraulic jar section of the present invention for delivering a downward jar or blow.

The first hydraulic jar section shown in FIG. 1 which is constructed and arranged to deliver an upward jar or blow is referred to generally at 10 and the second jar section which is constructed and arranged to deliver a downward jar or blow is referred to at 11 in FIG. 2 of the drawings.

Figure 3:
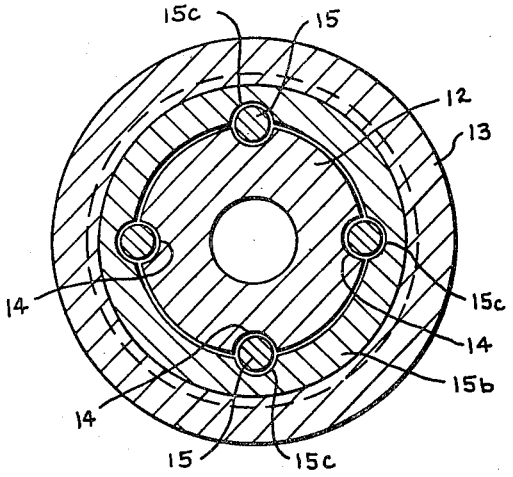
FIG. 3 is a sectional view on the line 3—3 of FIG. 1 and illustrates a drive arrangement for accommodating relative longitudinal movement between tubular sections of each hydraulic jar section while inhibiting relative rotation therebetween.
Figure 4:
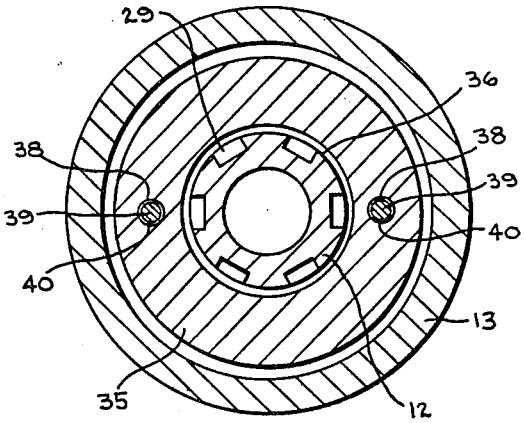
FIG. 4 is a sectional view on the line 4—4 of FIG. 1.

The first hydraulic jar section includes a first inner member 12 which is telescopically received within the first outer member 13. The inner member 12 is provided with circumferentially spaced and longitudinally extending arctuate grooves 14 in its outer periphery which match or mate with longitudinally extending annular pins 15 carried by the first outer member 13. As shown in FIG. 1, the pins 15 are received in arcuate grooves **15*c* formed in the end of sub 15*b*. A seat ring 15*d* rests on annular shoulder 15*e* on the outer member to retain pins 15 in grooves 15*c* when the inner member 12 and outer member 13 are secured together. This construction provides a splined drive arrangement to accommodate relative longitudinal but nonrotational movement between the first inner and outer members 12 and 13 as shown in FIGS. 1 and 3. Spaced seal means 20 and 20*a* are provided between the inner and outer members 12 and 13 and provide a chamber 20*b* for confining lubricating fluid and in which the drive means formed by pins 15 and grooves 14 is carried. In some situations, it may not be necessary to seal off the drive means in lubricating fluid, but generally it is preferred to do so. Suitable means are provided to equalize the pressure in chamber 20*b* with the well bore when it is sealed to confine lubricating fluid. The lower seal means 20*a* includes annular member 20*c* with seals 20*d* and 20*e* for sealably and slidably engaging the first inner and outer members 12 and 13 respectively to seal off therebetween. Thus the lower seal means 20*a* is a floating or movable seal responsive to the well bore pressure acting through passage means 20*f* in the outer member above seal means 17 and below seal means 20*a*** as shown.

Upper and lower longitudinally spaced seal means referred to generally at 17 and 18 respectively are provided between the first inner and outer tubular members 12 and 13 to form a first chamber 19 in the first jar section 10 for confining hydraulic operating fluid therein. The inner member 12 is provided with a longitudinal bore **12*f*** for communicating fluid through the drill string.

The inner member 12 carried an outwardly projecting coupling member 21 which is positioned on the inner member 12 above and in spaced relation to the seal means **20*a*. The members 15*d* and 21 respectively have end surfaces 22 and 23 on that form jarring surfaces on the first inner and outer tubular members 12 and 13** for jarring contact with each other to deliver an upward jar to a stuck drill string or an object stuck in the well bore as will be described.

Figure 5:
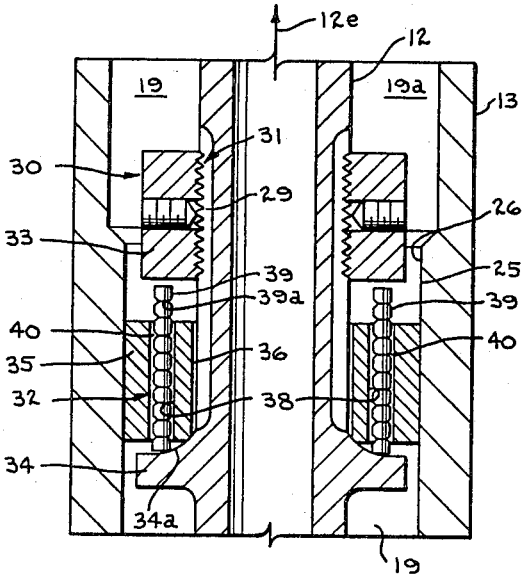
FIG. 5 is a sectional view illustrating one form of a piston means, restriction means and meter means which may be employed in the up hydraulic jar section.
Figure 8:
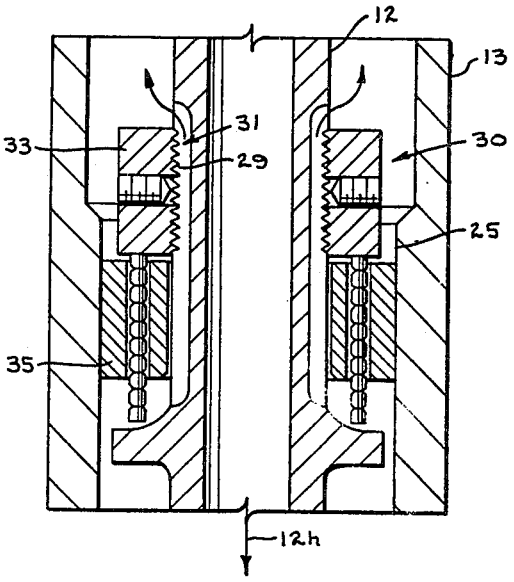
FIG. 8 is a sectional view similar to FIG. 5 but illustrating the components in a different relationship.

Longitudinally extending, annular first restriction means 25 are provided on the first outer member 13 within the first chamber 19 and as shown in FIG. 1 it terminates between the ends of the first chamber 19 so that the first piston means referred to generally at 30 may be moved through and beyond first restriction means in either direction into chamber portion **19*a* or 19*b* of chamber 19. The first piston means 30 include fluid bypass means 31 and fluid meter means referred to generally at 32 in FIG. 5. The piston means 30 also includes a collar 33 which is secured on the inner member 12 by any suitable means such as that illustrated in FIG. 5, which collar 33 is in spaced relation to the annular shoulder 34 also carried on the first inner member 12 as shown in FIG. 5. The fluid bypass means referred to generally at 31 is formed in any suitable manner, and as shown includes a plurality of longitudinally extending, circumferentially spaced passages 29 on inner member 12 which passages extending beyond the collar 33 at one end thereof and terminate at their other end adjacent the annular shoulder 34 of the first inner member 12**.

The fluid meter means 32 includes the first annular member 35 which is preferably formed of nonferrous material and loosely fits on the first inner member 12 between the collar 33 and the annular extension 34 to provide an annular clearance 36 between the first inner member 12 and the first member 35. The member 35 also includes at least one passage 38 extending therethrough with a pin 39 extending through the passage. A pair of passages 38 and pins 39 are shown.

It will be noted that the diameter of the pins 39 is smaller than the diameter of the opening or passages 38 through the annular member 35 in which the pins are received so that a fluid restriction or meter means passage 40 is formed therebetween. It will also be noted that the first annular member 35 is of less longitudinal extent than the longitudinal distance between the collar 33 and the annular extension 34 on the first inner member 12. Thus, the annular member 35 may move on pins 39 longitudinally of the first inner member 12 between the collar 33 and the annular projection 34 so that operating fluid in the first chamber 19 may be either unrestrictedly bypassed around the first piston means 30, or the meter means 32 may be actuated to initiate and create a tension load for applying an upward jar as will be described.

The pins 39 include circumferentially extending, longitudinally spaced grooves 39*a* as shown, and as the member 35 shifts back and forth on pins 39, any sediment in the operating fluid which may have been retained in the restriction means 40 will be flushed out.

Also, the annular seating surface 34*a* is arcuate as shown and this configuration will assist in urging member 35 into fluid sealing engagement with first restriction means 25 when the member 35 is seated on arcuate surface 34*a*.

Figure 10:
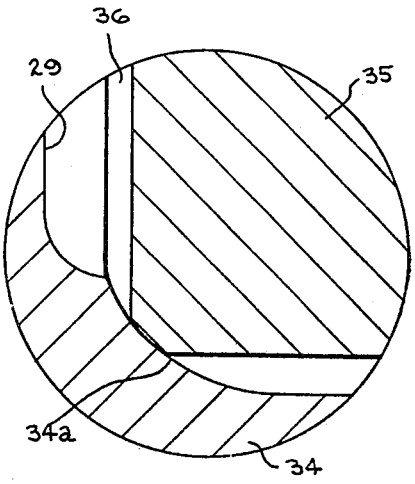
FIG. 10 is an enlarged partial sectional view of the piston means, restriction means and meter means.

When the drill string becomes stuck, and as the first inner member 12 is moved to an extended position relative to the outer member 13 as illustrated by the arrow 12*e* in FIG. 5, the member 35 will be positioned adjacent the lower end of first annular restriction 25. When this occurs the member 35 will seat on surface 34*a* and sealably engage the annular surface 26 of the first annular restriction means 25 as shown in FIGS. 5 and 10 of the drawings. The arcuate surface 34*a* assists in urging annular member 35 into engagement with the first annular restriction means 25 to close off flow between member 35 and restriction 25. The member 35 seats on surface 34*a* to close off fluid flow through the longitudinal grooves 29 as long as the annular member 35 is slidably and sealably engaged with first annular restriction 25 as illustrated in FIGS. 5 and 10. FIG. 5 shows the member 35 near the upper end of first restriction means 25, shortly before it disengages therefrom in chamber portion 19*a*. Continued upward movement of the inner member 12 relative to the outer member 13 causes fluid to flow through the restricted annular openings, or metering passages 40 between the pins 39 and the openings 38 in the annular member 35 while it is slidably and sealably engaged with first restriction means 25. The restriction of the flow of the hydraulic fluid in the first chamber 19 from above the first piston means 30 to beneath the first piston means 30 by such arrangement causes a tension load and stretching of the drill string in which the inner member 12 is connected and thus causes a tension load or force to be built up in the drill string in which the first inner and outer members 12 and 13 are carried.

As the fluid is metered from one side of the annular member 35 to the other, the tension or pull on inner member 12 pulls first piston means 30 upwardly through and out of the first annular restriction means 25, and annular member 35 then enters chamber portion 19*a* of first chamber 19 above the first restriction 25 so that fluid then flows unrestrictedly around member 35 from the top of first chamber 19 above the member 35 to the first chamber 19 beneath member 35. Thus, the flow of hydraulic fluid is suddenly released from the top of the first piston means 30 in the first chamber 19 to the bottom of chamber 19 beneath the first piston means 30 to accommodate unrestrained relative longitudinal movement between the members 12 and 13. This causes the member 12 to move up rapidly and unrestrained relative to outer member 13 so that the jarring surfaces 22 and 23 engage to deliver an upward jar to the well string in which the tool is connected.

During the upward movement of the first inner member 12 relative to the first outer member 13 of the first hydraulic jar section 10 to deliver an upward jar, the second hydraulic jar section 11 is inoperative so that it will not interfere with the proper functioning of the first hydraulic jar section to deliver an upward jar as will be described.

Suitable means are provided to equalize the pressure in the first hydraulic jar section adjacent the lower end of the first chamber 19 with the pressure in the well bore and to this end it will be noted that the lower seal means 18 includes an annular member 18*a* with seals 18*b* and 18*c* for sealably and slidably engaging the first outer member 13 and first inner member 12 respectively to seal off therebetween. Thus, the lower seal means 18 is a floating or movable seal and is responsive both to the operating fluid confined in the first chamber 19 and to well bore pressure which acts thereon through passage 18*h*. Seal means 17*a* between the first inner member 12 and first outer member 13 are provided in sub 16 beneath the lower seal means 18.

A suitable threaded connection as illustrated at 12' is provided at the upper end of the first inner member 12 so that it may be engaged with a drill string, and suitable threads 13' are provided at the lower end of the first outer member 13 to enable the first hydraulic jar section 10 to be connected with the second hydraulic jar section 11 by threadedly engaging 13' and 12*c*, or if desired a tubular member T may be placed between jars 10 and 11 to space them as desired longitudinally in the drill string.

In some situations, it may be desirable to employ only the up first jar section 10, or the second down section jar 11, in the drill string. Thus, they can be individually used and transported, if desired.

The second hydraulic jar section 11 includes second inner and outer telescopically arranged members 12*a* and 13*a* respectively which are generally similar in configuration to the first inner and outer tubular members 12 and 13 respectively.

Similarly, a splined drive connection is formed by grooves 14*a* in the second inner member 12*a* and pin means 15*a* carried by the second outer member 13*a* in a manner similar to that described with regard to FIGS. 1 and 3 to accommodate relative longitudinal movement between the second inner member 12*a* and second outer member 13*a* while inhibiting relative rotation therebetween. The second inner member 12*a* is provided with a bore 12*g* for communicating fluid through the drill string.

Jarring surfaces 23*a* on the second outer member and 22*a* on the second inner member are provided for jarring contact with each other to deliver a downward jar as will be described in greater detail hereinafter.

Second upper and lower longitudinally spaced seal means referred to at 40' and 45 are provided between said second inner and outer tubular members 12*a* and 13*a* to form a second chamber 50 in the second jar section 11 for confining hydraulic operating fluid therein. Means to equalize pressure in the well bore with the pressure adjacent an end of the chamber 50 include the passage **18*h* in the outer member for communicating well bore pressure to the movable barrier on seal 40', which is similar to seal means 18. An annular member 18*a* includes seals 18*b* and 18*c* which engage outer member 13*a* and inner member 12*a*** respectively.

The second inner member **12*a* is provided with second piston means referred to generally at 30*a* within the second chamber 50 and the second outer member 13*a* is provided with second annular and longitudinally extending restriction means 25*a* within the second chamber means 50. The second restriction means 25*a* terminates between the ends of the chamber 50 so that second piston means 30*a* can move through and beyond the second restriction means 25*a* into chamber portions 50*a* and 50*b***.

Figure 9:
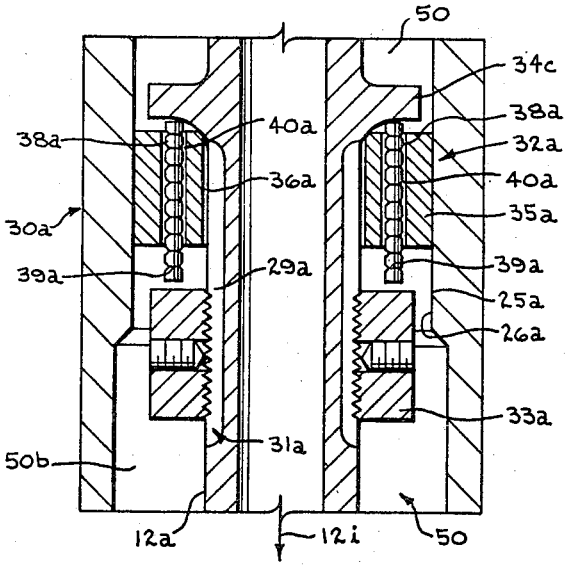
FIG. 9 is a sectional view similar to FIG. 5 but showing the arrangement of the piston means, restriction means and meter means employed in the down hydraulic jar section.

The second piston means **30*a* include fluid bypass means 31*a* and fluid meter means 32*a* shown in FIG. 9 which are similar in construction to fluid bypass means 31 and fluid meter means 32 shown in FIG. 5. The second piston means 30*a* includes the collar 33*a* and the annular extension or shoulder 34*c* on the second inner member 12*a*. These are each similar in arrangement and relationship on the second inner member 12*a* as they are on the first inner member 12, but the relationship is reversed as shown in FIG. 9. That is, as shown in FIG. 9 the collar 33*a* is beneath and longitudinally spaced from the annular shoulder 34*c* on the second inner member 12*a*, whereas as shown in FIG. 5, the collar 33 is above and longitudinally spaced from the annular shoulder or extension 34 on the first inner member 12. The second piston means 30*a* includes the second annular member 35*a* having at least one opening 38*a* extending therethrough with a pin 39*a* in the opening 38*a* to form a fluid restriction or metering means 40*a* similar to that described with regard to FIGS. 1 and 5. A pair of openings 38*a* and pins 39*a* are shown in FIG. 9**.

Seal means 20' and **20*a'* are provided to form a sealed chamber 20*b'* for the drive pins 15*a* and splines 14*a*. The seal means 20*a'* includes the annular member 20*c'* with seals 20*e'* and 20*d'* between inner and outer members 12*a* and 13*a*, respectively, to form a movable barrier to equalize pressure in the well bore with the pressure adjacent an end of chamber 20*b*, since opening 18*h* in outer member 13*a* communicates well bore pressure to act on movable seal 20*a'***.

If it is desired to deliver a downward jar to the stuck well string, the second piston means **30*a* is positioned adjacent the upper end of second annular restriction 25*a* in the second chamber 50 as shown in FIG. 9. When the second inner member 12*a* is thereafter moved downwardly as indicated by arrow 12*i* in FIG. 9 relative to the second outer member 13*a* to position second annular member 35*a* adjacent second annular restriction 25*a* as shown in FIG. 9, the second member 35*a* moves upwardly against the annular shoulder 34*a* to close off flow of fluid between it and the second restriction 25*a* and through fluid bypass passages 29*a* from the chamber portion 50*b* beneath the second member 35*a* to the chamber portion 50*a* above the member 35*a* while member 35*a* is slidably and sealably engaged with the second annular restriction 25*a* as 12*a* is moved downwardly. This causes fluid to flow through restriction or metering passages 40*a* in the second piston means 35*a* and restrains relative downward longitudinal movement of the first inner member 12*a* with respect to the second outer member 13*a* and places a compression load on the drill string or well string in which the present invention is connected until the member 35*a* has moved through, or disengaged from the second annular restriction 25*a* on its downward travel. As soon as the second piston means 30*a* has moved out of the second annular restriction 25*a* and enters the chamber portion 50*b* of second chamber 50 beneath second annular restriction 25*a* as the second inner member 12 is moved downwardly, hydraulic fluid in the second chamber 50 is free to move unrestrictedly from beneath the second piston means 30*a* to thereabove in second chamber 50 and this accommodates unrestrained relative longitudinal movement of the second inner member 12*a* and second outer member 13*a* until the jarring surfaces 22*a* and 23*a*** engage to deliver a downward jar to the well string.

The inner members 12 and **12*a* may each be formed of tubular sections each of which is threadedly engaged with the noncircular coupling 21 so as to provide ample clearance between it and the first and second outer members 13 and 13*a* respectively so that movement of inner members 12 and 12*a* relative to their respective outer sections 13 and 13*a*** will not be impeded by well fluids present in each jar section above the closed chambers.

Figure 7:
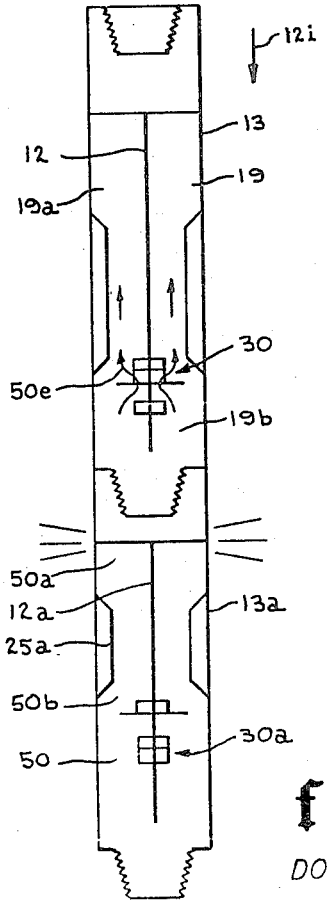
FIG. 7 is a schematic representation illustrating the spacial relationship of the components of the present invention after a down jar has been effected by the hydraulic down jar section.
Figure 6:
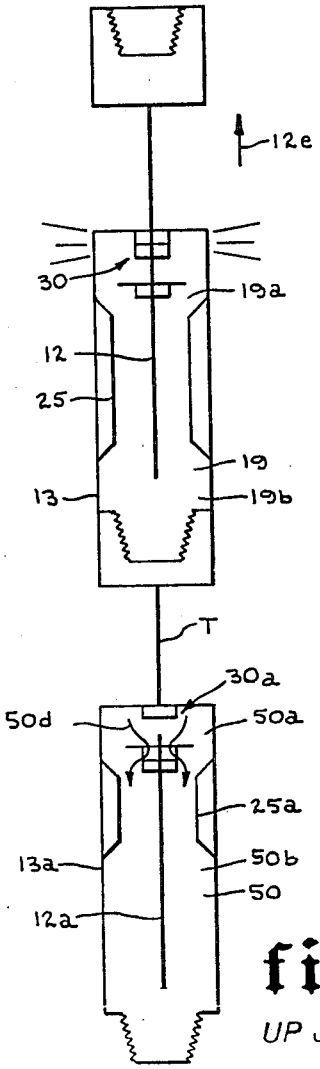
FIG. 6 is a schematic representation illustrating the spacial relationship of the components of the present invention after an up jar has been effected by the hydraulic up jar section.

In FIGS. 6 and 7 the first inner and outer members 12 and 13 of the first jar section are diagrammatically illustrated as is the second inner and outer members **12*a* and 13*a* of the second jar section. They also are diagrammatically shown as being connected together even though they may be longitudinally spaced in the drill string by tubular member T. The first annular restriction means 25 in the first chamber 19 and the second restriction means 25*a* in the second chamber means 50 are also diagrammatically represented, as is the first and second annular piston means 30 and 30*a* and their respective meter means on the first and second inner members 12 and 12*a* in each chamber 19 and 50** respectively.

FIG. 6 illustrates the relationship of the components of each jar section at the time that an up jar has been applied. Such figure also illustrates the spacial relationship of the piston means and restriction means of each jar section relative to each other when the drill string is in tension during rotary drilling operations, as will be explained.

FIG. 6 will be described first as it illustrates an upward jar as indicated by the arrow **12*e*. It can be appreciated that the upward jar applied by the first jar section 10 to the drill string has been effected by moving the first piston means 30 up into and then through the first restriction means 25 to initially restrain relative longitudinal movement between the inner and outer members 12 and 13 respectively, and to thereafter permit unrestrained relative longitudinal movement between the inner and outer members 12 and 13 when the piston means 30 clears the first restriction means 25 and moves into the chamber portion 19*a* above the first restriction means 25 as shown. At such time the shoulders 23 and 22 shown in FIG. 1 engage to deliver an up jar to the drill string. It can be appreciated that the second piston means 30*a* and its metering arrangement during such operation accommodates free unrestricted flow of fluid between the chamber portions 50*a* and 50*b* of the second chamber 50 as represented by the arrows at 50*d* in FIG. 6**.

FIG. 6 also illustrates the relationship of the first and second piston means 30, **30*a* to their respective restriction means 25 and 25*a* when the drill string is in tension during rotary drilling operations. It will be noted that the spacial relationship is such that the first piston means 30 and second piston means 30***a* are each respectively spaced axially from the first and second restriction means 25 and 25*a* as diagrammatically illustrated. Thus, the jarring mechanism of the first hydraulic jar section 10 and second hydraulic jar section 11 is disengaged during normal rotary drilling operations while the drill string is in tension to prevent wear and damage thereto.

Similarly, it will be noted that as shown in FIG. 7 the first piston means 30 and second pistons means 30*a* is spaced axially relative to their respective first and second restriction means 25 and 25*a* of each jar section 10 and 11 while the rotary drill string is in compression and during rotary drilling operations. Since the hydraulic jarring mechanisms of each jar section are spaced and disengaged, wear and possible damage thereto is substantially reduced.

FIG. 7 illustrates the function of the second hydraulic jar section 11 in applying a down jar to the drill string. The down jar will have been accomplished by applying a compressive force as represented by the arrow 12*i* to the drill string in which the jar section is connected to move the second piston means 30*a* from the top of the second restriction means 25*a* adjacent the chamber portion 50*a*, through the second restriction means 25*a* at which time relative longitudinal movement between the second inner and outer members 12*a* and 13*a* is restricted. As soon as the second piston means 30*a* clears the second restriction means 25*a*, the members 12*a* and 13*a* may move longitudinally unrestrictedly so that surfaces 22*a* and 23*a* shown in FIG. 2 engage and impart a down jar to the drill string.

The first piston means 30 and its fluid meter means diagrammatically illustrated in FIG. 7 of the drawings during the function of the down jar freely accommodate the passage of fluid from the chamber portion 19*b* to the chamber portion 19*a* of chamber 19 in the first jar section 10 as represented by the arrows 50*e*.

If it is desired to apply a plurality of sequential up jars or down jars to the drill string, the hydraulic jar sections 10 and 11 of the present invention automatically reset to accomplish such function. In prior art devices, an indeterminate and substantial amount of time may be required to reposition a jar after it has jarred on one direction, before it can be employed to apply another jar in the same direction.

For example, by referring to FIG. 6, after an up jar has been applied to the drill string, the drill string may be lowered in which event the first piston means 30 will move unrestrictedly through the first restriction means 25 as illustrated in the upper part of FIG. 7 by the arrows 50*e*. Such down movement of the first piston means 30 will continue and during such movement the weight indicator at the earth's surface may be visually or instrumentally noted and it normally will remain substantially constant. However, when the second piston means 30*a* begins to enter the second restriction means 25*a*, the weight indicator at the earth's surface will indicate a decrease due to the restricted relative longitudinal movment between the second inner and outer members 12*a* and 13*a*. At such time, the first piston means 25 will have assumed a position in chamber portion 19*b* beneath the first restriction means 25 so that the drill string can be placed in tension to immediately apply another upward jar to the drill string. This operation may be repeated as desired.

Similarly, if it is desired to apply a plurality of sequential down jars to the drill string, the drill string will be lifted after the down jar has been effected whereupon the second pistons means 30*a* will move upwardly unrestrictedly through the second restriction means 25*a*, since its meter means will accommodate free flow of the operating fluid at such time as indicated in the lower part of FIG. 6. During such upward movement of the drill string, the weight on the weight indicator at the earth's surface will remain substantially constant until the first piston means 30 and its associated meter means begins to enter the first restriction means 25, at which time an increase in the weight on the weight indicator will occur, thus signalling that the first piston means 30 and its associated meter means has begun to move into the first restriction means 25. The spacial arrangement of the first piston means 30 in the first jar section 10 and the second piston means 30*a* in the second jar section 11 as well as the spacial relationship of the restriction means 25 and 25*a* is such that when an increase in the weight indicator occurs as the drill string is moved up, this indicates that the second piston means 30*a* is positioned in the chamber portion 50*a* above the second restriction means 25*a* and ready to be actuated to deliver another down jar.

As noted previously, the jar sections 10 and 11 are separate and each include their own operating mechanism as described hereinabove. They be employed alone, or simultaneously in a drill string. Each jar section is constructed and arranged so that its jarring mechanism and drive is equalized with the pressure of the well bore and will function independently of the well bore.

Also, as described and noted hereinabove, the piston means in each separate jar section is disengaged and spaced axially from its respective restriction means when the drill string is in compression or tension during rotary drilling operations. The restriction means of each jar section terminates intermediate the ends of its respective chamber to enable the piston means associated with each jar section to be above the restriction means when the drill string is in tension during rotary drilling operations and enables each piston means of each jar section to be beneath its respective restriction means when the drill string is in compression during rotary drilling operations.

While the invention has been described in detail as utilizing piston means on the inner member and an annular restriction means on the outer member as the hydraulic arrangement, such as for purposes of illustration only. It can be appreciated that any hydraulic arrangement which cooperates to initially restrain relative longitudinal movement, and then accommodate unrestricted relative longitudinal movement of the longitudinal members and which is disengaged while the drill string is either in tension or compression during rotary drilling operations may be employed.

Also, the invention may be employed in any well string to recover a tubular member stuck in the well bore.

The foregoing disclosure and description of the invention are illustrative and explanatory thereof, and various changes in the size, shape, and materials as well as in the details of the illustrated construction may be made without departing from the spirit of the invention.

What is claimed is:

1. A hydraulic jar arrangement for incorporating in a drill string for use in a well bore comprising:

a. a first hydraulic jar section for delivering an upward jar to the drill string when it is stuck in the well bore comprising:
1. a first outer tubular member;
2. a first inner tubular member telescopically arranged and terminating within said first outer tubular member;
3. longitudinally spaced seal means between said first inner and outer tubular members forming a first chamber in the drill string for confining hydraulic operating fluid;
4. jarring surfaces on said first inner and outer tubular members for jarring contact with each other to deliver an upward jar to the stuck drill string;
5. longitudinally extending, annular first restriction means on said first outer member within the first chamber;
6. first piston means on said first inner member within the first chamber; and
7. said first piston means including one-way acting fluid meter means operable when said first piston means is between the ends of said first restriction means for restraining relative longitudinal movement of said first inner and outer tubular members to an extended position, said fluid meter means operable after a predetermined relative longitudinal movement between said first inner and outer tubular members to release said first inner and outer tubular members for subsequent unrestrained relative longitudinal movement therebetween until said jarring surfaces on said first inner and outer tubular members engage and deliver an upward jar to the stuck drill string;

b. a second hydraulic jar section for delivering a downward jar to the drill string when it is stuck in the well bore comprising:
1. a second outer tubular member;
2. a second inner tubular member telescopically arranged and terminating within said second outer tubular member;
3. longitudinally spaced seal means between said second inner and outer tubular members forming a second chamber in the drill string for confining hydraulic operating fluid;
4. jarring surfaces on said second inner and outer tubular members for jarring contact with each other to deliver a downward jar to the stuck drill string;
5. longitudinally extending, annular second restriction means on said second outer member within the second chamber;
6. second piston means on said second inner member within the second chamber; and
7. said second piston means including one-way acting fluid meter means operable when said second piston means is between the ends of said second restriction means for restraining relative longitudinal movement of said second inner and outer tubular members to a telescoped position, said fluid meter means operable after a predetermined relative longitudinal movement between said second inner and outer tubular members to release said second inner and outer tubular members for subsequent unrestrained relative longitudinal movement therebetween until said jarring surfaces on said second inner and outer tubular members engage and deliver a downward jar to the stuck drill string;

c. additional spaced seal means between said first inner and outer tubular members and between said second inner and outer tubular members forming an additional chamber in each of said first and second hydraulic jar sections for confining a lubricating fluid;

d. drive means in each of the additional chambers for connecting said first inner and outer tubular members and said second inner and outer tubular members to prevent relative rotation, while accommodating relative longitudinal movement, between said first inner and outer tubular members and between said second inner and outer tubular members respectively;

e. means in the first hydraulic jar section to equalize pressure adjacent one end of each the first chamber and the additional chamber with the pressure in the well bore whereby an upward jarring force may be effected in the stuck drill string independently of any well bore pressure; and f. means between the second chamber and the additional chamber in said second hydraulic jar section to equalize pressure adjacent one end of each the second chamber and the additional chamber with the pressure in the well bore whereby a downward jarring force may be effected in the stuck drill string independently of any well bore pressure.

2. The invention of claim 1 wherein said means to equalize pressure includes:
a. movable seal means adjacent one end of each the first, second and additional chambers of each said first and second hydraulic jar sections;
b. said movable seal means sealably engaging said first and second tubular members in each the first, second and additional chambers of each said first and second hydraulic jar sections; and
c. said outer tubular member having passage means for communicating well bore pressure to act on said movable seal means in each the first, second and additional chamber of each said first and second hydraulic jar sections.

3. The invention of claim 1 wherein said first and second restriction means is positioned intermediate the ends of the first and second chambers respectively whereby said first and second piston means is axially spaced from their respective restriction means when the drill string is in tension and compression during rotary drilling operations.

4. The invention of claim 1 including tubular connection means releasably connected between said first and second jar sections to longitudinally space them in the drill string.

5. A hydraulic jar arrangement for incorporating in a drill string for use in a well bore comprising:
a. a first hydraulic jar section for delivering an upward jar to the drill string when it is stuck in a well bore comprising:
1. a first outer tubular member;
2. a first inner tubular member telescopically arranged and terminating within said first outer tubular member;
3. longitudinally spaced seals means between said first inner and outer tubular members forming a first chamber in the drill string for confining hydraulic operating fluid;

4. jarring surfaces on said first inner and outer tubular members for jarring contact with each other to deliver an upward jar to the stuck drill string; and
5. first hydraulic jar means formed by cooperating means on said first inner and outer tubular members within the first chamber for restraining relative longitudinal movement of said first inner and outer tubular members to an extended position, said cooperating means operable after a predetermined relative longitudinal movement between said first inner and outer tubular members to release said first inner and outer tubular members for subsequent unrestrained relative longitudinal movement therebetween until said jarring surfaces engage with each other to deliver an upward jar to the stuck drill string;

b. a second hydraulic jar section for delivering a downward jar to the drill string when it is stuck in the well bore comprising:
1. a second outer tubular member;
2. a second inner tubular member telescopically arranged and terminating within said second outer tubular member;
3. longitudinally spaced seal means between said second inner and outer tubular members forming a second chamber in the drill string for confining hydraulic operating fluid;
4. jarring surfaces on said second inner and outer tubular members for jarring contact with each other to deliver a downward jar to the stuck drill string; and
5. second hydraulic jar means formed by cooperating means on said second inner and outer tubular members within the second chamber for restraining relative longitudinal movement of said second inner and outer tubular members to a telescoped position, said cooperating means operable after a predetermined relative longitudinal movement between said second inner and outer tubular members to release said second inner and outer tubular members for subsequent unrestained relative longitudinal movement therebetween until said jarring surfaces on said second inner and outer tubular members engage with each other to deliver a downward jar to the stuck drill string;

c. additional spaced seal means between said first inner and outer tubular members and between said second inner and outer tubular members forming an additional chamber in each of said first and second hydraulic jar sections for confining a lubricating fluid;

d. drive means in each of the additional chambers for connecting said first inner and outer tubular members and said second inner and outer tubular members to prevent relative rotation, while accommodating relative longitudinal movement, between said first inner and outer tubular members and between said second inner and outer tubular members respectively;

e. means in the first hydraulic jar section to equalize pressure adjacent one end of each the first chamber and the additional chamber with the pressure in the well bore whereby an upward jarring force may be effected in the stuck drill string independently of any well bore pressure; and f. means between the second chamber and the additional chamber in said second hydraulic jar section to equalize pressure adjacent one end of each the second chamber and the additional chamber with the pressure in the well bore whereby a downward jarring force may be effected in the stuck drill string independently of any well bore pressure.

6. The invention of claim 5 wherein said means to equalize pressure includes:

a. movable seal means adjacent one end of each the first, second and additional chambers of each said first and second hydraulic jar sections;
b. said movable seal means sealably engaging said first and second tubular members in each the first, second and additional chambers of each said first and second hydraulic jar sections; and
c. said outer member having passage means for communicating well bore pressure to act on said movable seal means in each the first, second and additional chamber of each said first and second hydraulic jar sections.

7. The invention of claim 5 including tubular connection means releasably connected between said first and second jar sections to longitudinally space them in the drill string.

8. The invention of claim 5 wherein the cooperating means on each said first inner and second inner tubular members is spaced axially of the cooperating means on each said first outer and second outer tubular members respectively when the drill string is in tension and compression during rotary drilling operations.

9. A hydraulic jar arrangement for incorporating in a drill string for use in a well bore comprising:

a. a first hydraulic jar section for delivering an upward jar to the drill string comprising:
1. a first outer tubular member;
2. a first inner tubular member telescopically arranged and terminating within said first outer tubular member;
3. longitudinally spaced seals means between said first inner and outer tubular members forming a first chamber in the drill string for confining hydraulic operating fluid;
4. jarring surfaces on said first inner and outer tubular members for jarring contact with each other to deliver an upward jar to the drill string; and
5. first one-way acting fluid meter means in said first chamber for restraining relative longitudinal movement of said first inner and outer tubular members to an extended position, said first fluid meter means operable after a predetermined relative longitudinal movement between said first inner and outer tubular members for subsequent unrestrained relative longitudinal movement therebetween until said jarring surfaces engage with each other and deliver an upward jar to the drill string;

b. a second hydraulic jar section for delivering a downward jar to the drill string comprising:
1. a second outer tubular member;
2. a second inner tubular member telescopically arranged and terminating within said second outer tubular member;
3. longitudinally spaced seal means between said second inner and outer tubular members forming a second chamber in the drill string for confining hydraulic operating fluid;

4. jarring surfaces on said second inner and outer tubular members for jarring contact with each other to deliver a downward jar to the drill string; and
5. a second one-way acting fluid meter means in said second chamber for restraining relative longitudinal movement of said second tubular members to a telescoped position, said fluid meter means operable after a predetermined relative longitudinal movement between said second inner and outer tubular members to release said second inner and outer tubular members for subsequent unrestrained relative longitudinal movement therebetween until said jarring surfaces on said second inner and outer tubular members engage with each other to deliver a downward jar to the drill string;

c. additional spaced seal means between said first inner and outer tubular members and between said second inner and outer tubular members forming an additional chamber in each of said first and second hydraulic jar sections for confining a lubricating fluid;
d. drive means in each of the additional chambers for connecting said first inner and outer tubular members and said second inner and outer tubular members to prevent relative rotation, while accommodating relative longitudinal movement, between said first inner and outer tubular members and between said second inner and outer tubular members respectively;
e. means in the first hydraulic jar section to equalize pressure adjacent one end of each the first chamber and the additional chamber with the pressure in the well bore whereby an upward jarring force may be effected in the stuck drill string independently of any well bore pressure; and
f. means between the second chamber and the additional chamber in said second hydraulic jar section to equalize pressure adjacent one end of each the second chamber and the additional chamber with the pressure in the well bore whereby a downward jarring force may be effected in the stuck drill string independently of any well bore pressure.

10. The invention of claim 9 wherein said first and second one-way acting fluid meter means is constructed and arranged to maintain an inoperative relationship in the first and second chamber means, respectively, when the drill string is in tension and compression during rotary drilling operations.

11. The invention of claim 9 including tubular connection means releasably connected between said first and second jar sections to longitudinally space them in the drill string.

12. The invention of claim 9 wherein said means to equalize pressure includes:

a. movable seal means adjacent one end of each the first, second and additional chambers of each said first and second hydraulic jar sections;
b. said movable seal means sealably engaging said first and second tubular members in each the first, second and additional chambers of each said first and second hydraulic jar sections; and
c. said outer member having passage means for communicating well bore pressure to act on said movable seal means in each the first, second and additional chamber of each said first and second hydraulic jar sections.

13. In a hydraulic jar for use in a drill string in a well bore wherein inner and outer tubular members are connected by drive means to prevent relative rotation while accommodating relative longitudinal movement therebetween for engaging jarring surfaces on the members and wherein hydraulic jar means include a hydraulic operating fluid chamber formed by the inner and outer tubular members with cooperating means on the members in the chamber which are operable to restrain relative longitudinal movement of the inner and outer members and which are operable to release the inner and outer members for subsequent unrestrained relative longitudinal movement therebetween until the jarring surfaces engage to deliver a downward jar to the drill string, the invention of means between the drive means and the chamber to equalize pressure adjacent one end of the chamber with the pressure in the well bore whereby a downward jarring force may be effected in the drill string independently of well bore pressure.

14. In a hydraulic jar for use in a drill string in a well bore:

a. inner and outer telescopically arranged tubular members movable longitudinally relative to each other with means for connecting one end of each the inner and outer tubular members in the drill string;
b. jarring surfaces on said inner and outer tubular members for jarring contact with each other to deliver a down jar to the drill string.
c. spaced seal means between said inner and outer tubular members forming a first chamber in the drill string for confining hydraulic operating fluid;
d. additional spaced seal means between said inner and outer tubular members forming an additional chamber in the hydraulic jar for confining a lubricating fluid;
e. drive means in the additional chamber for connecting said inner and outer tubular members to prevent relative rotation, while accommodating relative longitudinal movement, between said inner and outer tubular members;
f. hydraulic jar means formed by cooperating means on said inner and outer tubular members within the first chamber to restrain relative longitudinal movement of said inner and outer tubular members and which are operable to release said inner and outer tubular members for subsequent unrestrained relative longitudinal movement therebetween until said jarring surfaces engage with each other to deliver a downward jar to the drill string; and
g. means between the first chamber and the additional chamber to equalize pressure adjacent one end of each the first chamber and the additional chamber with the pressure in the well bore whereby a downward jarring force may be effected in the drill string.

15. The invention of claim 14 wherein the cooperating means on said inner and outer tubular members is spaced axially when the drill string is in tension and compression during drilling operations.

16. The invention of claim 14 wherein said hydraulic jar means includes:

a. longitudinally extending annular restriction means on one of said tubular members, said restriction means terminating between the ends of the first chamber;
b. piston means on the other of said tubular members within the first chamber and spaced axially from said restriction means when the drill string is in tension and compression during rotary drilling operations; and c. said piston means including one-way acting fluid meter means which restrains relative longitudinal movement of said inner and outer tubular members as said piston means is moved through said restriction means by one of said members, whereby a compressive load is built up between said inner and outer members that effects rapid relative, unrestrained longitudinal movement between the inner and outer members when the restraint between said piston means and restriction means is released whereupon said jarring surfaces on said members engage to deliver a downward jar to the drill string.

17. The invention of claim 14 wherein the means to equalize pressure between the first chamber and the additional chamber includes:

a. movable seal means adjacent one end of each the first chamber and additional chamber;

b. said movable seal means sealably engaging said inner and outer tubular members in the first chamber and additional chamber; and c. said outer member having passage means for communicating well bore pressure to act on said movable seal means in the first chamber and additional chamber.

18. The invention of claim 1 wherein said one-way acting fluid meter means includes:

a. an annular shoulder on said piston means;

b. a ring secured on said piston means in spaced relation to said shoulder;

c. circumferentially spaced groove means extending beneath said ring and terminating in spaced relation to said shoulder;

d. an annular member of non ferrous material between said shoulder and ring with a circumferential surface for engaging said outer member;

e. said annular member having a plurality of holes therethrough;

f. a pin having a smaller outer diameter than said holes and extending through said holes between said shoulder and said ring to form restricted flow passages through said piston means; and g. said shoulder having a curved surface against which said annular member is adapted to seat and abut said circumferential surface against said outer member to restrict flow of fluid from one side of said piston means to the other within the chamber and thereby restrain relative longitudinal movement between said inner and outer tubular members.

* * * * *